US006510047B2

(12) United States Patent
Meiners et al.

(10) Patent No.: US 6,510,047 B2
(45) Date of Patent: Jan. 21, 2003

(54) CONDUCTIVE HEAT SINK

(75) Inventors: Steven E. Meiners, Beaver Falls, PA (US); Douglas M. Brandt, Elwood City, PA (US)

(73) Assignee: Eaton Corporation, Cleveland, OH (US)

( * ) Notice: Subject to any disclaimer, the term of this patent is extended or adjusted under 35 U.S.C. 154(b) by 27 days.

(21) Appl. No.: 09/799,239

(22) Filed: Mar. 5, 2001

(65) Prior Publication Data

US 2002/0122289 A1 Sep. 5, 2002

(30) Foreign Application Priority Data

Dec. 22, 2000 (JP) ..... 2000-391715
Mar. 1, 2001 (JP) ..... 2001-056740

(51) Int. Cl.[7] ..... H01H 73/00

(52) U.S. Cl. ..... 361/676; 361/672; 361/675; 361/115; 337/166; 218/118

(58) Field of Search ..... 361/673–676, 361/642–645, 115, 611; 337/166, 177, 186, 203, 231, 259, 414; 363/144; 218/118; 200/289; 335/8

(56) References Cited

U.S. PATENT DOCUMENTS 3,603,753 A * 9/1971 Frink ..... 200/144 B
3,611,107 A * 10/1971 Ruckel ..... 317/234
3,662,137 A * 5/1972 Cleaveland ..... 174/15 BH
3,810,063 A * 5/1974 Blewitt ..... 337/166
4,050,045 A * 9/1977 Motten et al. ..... 337/187
4,121,276 A * 10/1978 Kovatch et al.
4,123,618 A * 10/1978 Cushing et al. ..... 174/11 VH
4,419,715 A * 12/1983 Pear
5,753,875 A * 5/1998 Benke et al.
6,018,455 A * 1/2000 Wilkie, II et al.
6,034,861 A * 3/2000 Meiners et al. ..... 361/115

FOREIGN PATENT DOCUMENTS

DE 19850206 A1 * 4/2000 ..... H02B/13/00
JP 404109524 A * 4/1992 ..... H01H/33/66

* cited by examiner

*Primary Examiner*—Darren Schuberg
*Assistant Examiner*—Michael Datskovsky
(74) *Attorney, Agent, or Firm*—Martin J. Moran

(57) ABSTRACT

A conductive heat sink is electrically interposed between a fuse and a switching apparatus within a watertight case of a network protector. The heat sink is advantageously configured to conduct current between the switching apparatus and the fuse. During operation, the skin effect causes the electricity conducted by the heat sink to flow primarily through the outer regions of the heat sink, thereby resulting in the generation of heat at the outer regions of the heat sink due to electrical resistance. The heat sink includes a core from which a plurality of fins extend. The fins conduct and convect heat away from the outer regions of the heat sink, which reduces the temperature thereof and correspondingly increases the conductivity of the outer regions of the heat sink.

11 Claims, 3 Drawing Sheets

CONDUCTIVE HEAT SINK

BACKGROUND OF THE INVENTION

1. Field of the Invention

The present invention relates generally to power distribution equipment and, more particularly, to network protectors. Specifically, the invention relates to a conductive heat sink for use in a network protector.

2. Description of the Related Art

Network power delivery systems are well known in the relevant art for supplying electrical power throughout municipalities and for other applications. Network systems typically include a network bus to which all of the loads are connected, with the network bus typically being of a multi-pole configuration. The network bus is supplied with electricity from a plurality of substations or other power sources that are connected to the network bus. As is further understood in the relevant art, a network protector is electrically interposed between the network bus and each of the power sources in order to insulate the network bus from non-network electrical problems, and for other purposes.

A typical network protector includes a switching apparatus and a fuse that are sealed within a substantially watertight case, and the case is typically disposed below grade for connection with the network bus. A network transformer typically is mounted on the outer surface of the case for stepping down the voltage from the power source level to the network level.

The switching apparatus typically includes a switch that is generally in the configuration of a multi-pole circuit breaker having an operating mechanism and a trip unit, in which the trip unit does not function in response to overcurrent or under-voltage conditions. Rather, the trip unit functions to cause the operating mechanism to separate a set of movable contacts from a set of stationary contacts to interrupt the flow of current therethrough in response to a reverse current situation. The switch also permits manual disconnection of a power source from the network bus for various reasons.

The fuse of the network protector includes a fusible body manufactured out of copper/lead combinations or other materials that "fuse" or melt under certain specified conditions to protect the network bus. For instance, the fusible body may melt and interrupt current in the event that the network transformer experiences a fault on the secondary winding thereof. Also, the fusible body may melt in the event of a reverse-current condition. The fusible body can also melt in the event of arc faults within the network protector or network transformer, and can also melt in the event of failure of the watertight case whereby water may be admitted into the interior of the case. The fusible body also may melt in the event of a failure with the switch. While such network protectors have been generally effective at achieving their intended purposes, such network protectors nevertheless have not been without limitation.

During operation of the network protector, both the fuse and the switch generate substantial amounts of heat. Such heat, if permitted to be conducted to the network bus, can raise the temperature of the network bus beyond applicable limits. Both the switch and the fuse are, however, sealed within the case which is watertight, whereby convection of the heat directly away from the fuse and the switch is extremely limited. It is thus desired to provide a network protector having an enhanced ability to cool the fuse and the switch thereof within the confines of the watertight case.

SUMMARY OF THE INVENTION

In view of the foregoing, a conductive heat sink is electrically interposed between a fuse and a switching apparatus within a watertight case of a network protector. The heat sink is advantageously configured to conduct current between the switching apparatus and the fuse. During operation, the skin effect causes the electricity conducted by the heat sink to flow primarily through the outer regions of the heat sink, thereby resulting in the generation of heat at the outer regions of the heat sink due to electrical resistance. The heat sink includes a core from which a plurality of fins extend. The fins conduct and convect heat away from the outer regions of the heat sink, which reduces the temperature thereof and correspondingly increases the conductivity of the outer regions of the heat sink.

As such, an object of the present invention is to provide a conductive heat sink that can be used in a network application.

Another object of the present invention is to provide a conductive heat sink that conducts power therethrough.

Another object of the present invention is to provide a conductive heat sink that convects heat to its surrounding environment.

Another object of the present invention is to provide a conductive heat sink that can conduct heat away from componentry with which the heat sink is connected.

Accordingly, an aspect of the present invention is to provide an electrically conductive heat sink structured to be electrically interposed within an electrical circuit between a first conductor having a first electrical potential and a second conductor having a second electrical potential, the first electrical potential being different than the second electrical potential, in which the general nature of the heat sink can be stated to include a core, a plurality of fins extending outwardly from the core, the core and the fins being integrally formed with one another as a monolithic member, and the core having an initial end and a terminal end opposite one another. The initial end is structured to be electrically conductively engaged with the first conductor of the electrical circuit, the terminal end is structured to be electrically conductively engaged with the second conductor of the electrical circuit. The heat sink is manufactured at least partially out of an electrically conductive material and is structured to conduct current between the first conductor and the second conductor. The initial end and the terminal end each include one of a socket and a fastener.

In an embodiment of the heat sink, the initial end includes a socket that extends into a substantially planar first engagement surface and that is threaded and is structured to received a first threaded fastener therein, and the terminal end includes a second threaded fastener that extends outwardly from a substantially planar second engagement surface. In another embodiment the heat sink is formed by casting the electrically conductive material around the second threaded fastener.

Another aspect of the present invention is to provide in combination a fuse and an electrically conductive heat sink. The heat sink is electrically and thermally conductively engaged with the fuse, with the heat sink being structured to be electrically conductively connected with a conductor and being structured to conduct current between the conductor and the fuse and being further structured to conduct heat away from the fuse. The heat sink can be generally stated as including a core and a plurality of fins extending outwardly from the core, with the core and the fins being integrally formed with one another as a monolithic member, and with the core having an initial end and a terminal end opposite one another. The initial end is structured to be electrically conductively engaged with the conductor, and the terminal end is structured to be electrically and thermally conductively engaged with the fuse. The heat sink is manufactured at least partially out of an electrically conductive material. The initial end includes one of a socket and a fastener, and the terminal end includes one of a fastener protruding outwardly therefrom and a socket having a fastener therein.

Still another aspect of the present invention is to provide a network protector that can be generally stated as including a switching apparatus, a fuse, and an electrically conductive heat sink electrically interposed between the switching apparatus and the fuse. The heat sink is structured to conduct current between the switching apparatus and the fuse, and is further structured to conduct heat away from the fuse. The heat sink includes a core and a plurality of fins extending outwardly from the core, with the core and the fins being integrally formed with one another as a monolithic member. The core has an initial end and a terminal end, with the initial end being electrically conductively engaged with the switching apparatus, and the terminal end being electrically and thermally conductively engaged with the fuse. The heat sink is manufactured at least partially out of an electrically conductive material.

BRIEF DESCRIPTION OF THE DRAWINGS

A further understanding of the present invention can be obtained from the Description of the Preferred Embodiment and the accompanying drawings in which.

Similar numerals refer to similar parts throughout the specification.

DESCRIPTION OF THE PREFERRED EMBODIMENT

A conductive heat sink 4 in accordance with the present invention is indicated generally in FIGS. 1–5. The conductive heat sink 4 can be advantageously incorporated into a network protector 8 (FIG. 3) to reduce the operating temperature of certain componentry thereof, although it is understood that the conductive heat sink 4 can be used in applications other than a network protector without departing from the concept of the present invention.

Figure 3:
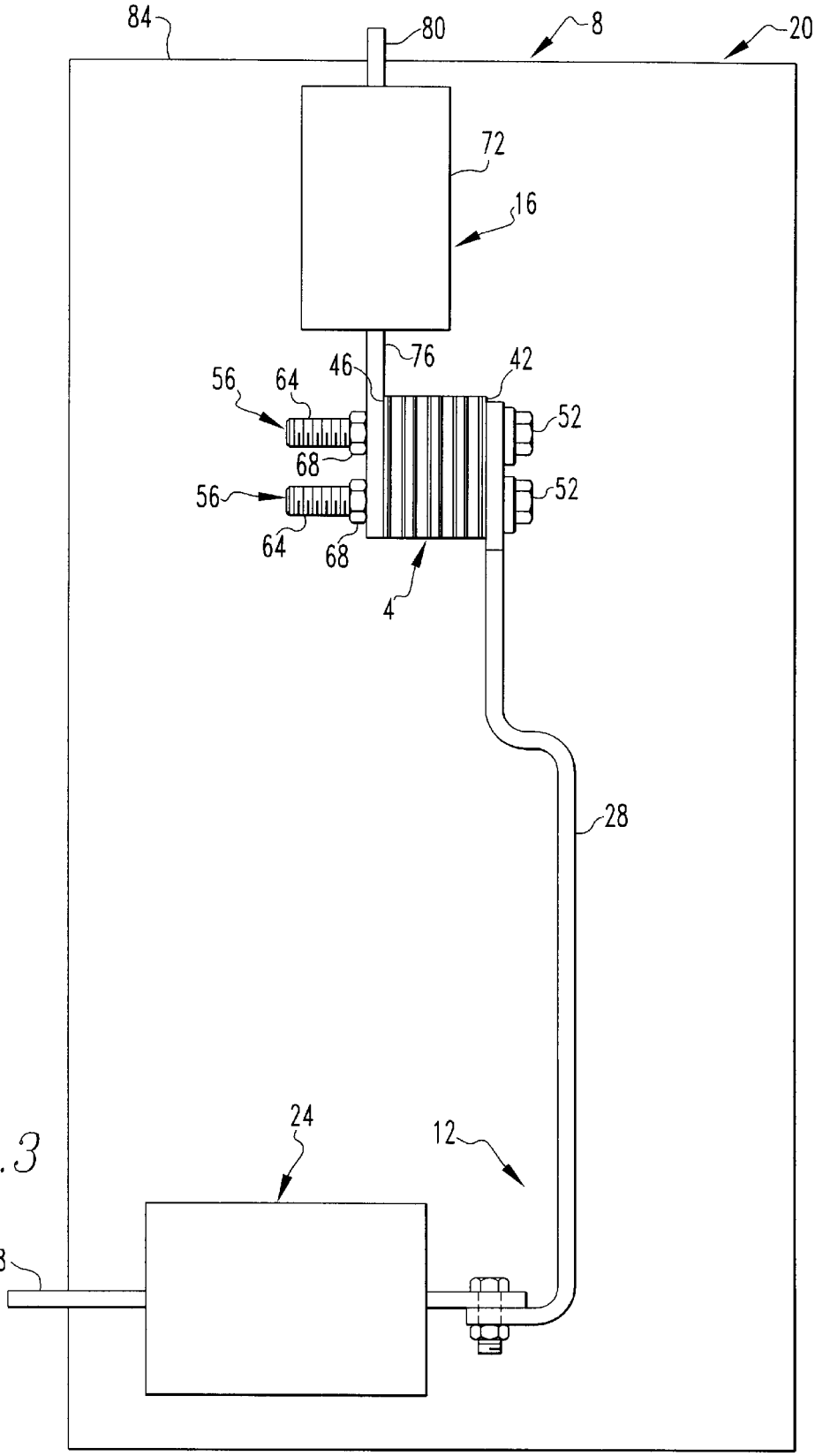
FIG. 3 is a schematic view of a network protector incorporating the present invention.

As can be understood from FIG. 3, the network protector 8 includes a switching apparatus 12 and a fuse 16 that are electrically and thermally conductively engaged with the heat sink 4. The network protector 8 additionally includes a substantially watertight case 20 that retains therein the heat sink 4, the switching apparatus 12, and the fuse 16. While the case 20 is typically installed below grade for connection with a network bus (not shown), in other applications the case 20 may be installed above grade without departing from the concept of the present invention.

It is understood that the network protector 8 is of a multi-pole configuration, meaning that the switching apparatus 12 simultaneously controls three or more poles, with a fuse 16 and a heat sink 4 being electrically and thermally conductively connected with each pole. For purposes of simplification, the switching apparatus 12 will be depicted herein as being connected only with a single heat sink 4 and fuse 16, it being understood that that the number of additional heat sinks 4 and fuses 16 that are employed depends upon the number of poles that are desired to be handled by the network protector 8.

As can further be seen from FIG. 3, the switching apparatus 12 includes a switch 24 and a conductor 28, the switch 24 being electrically and thermally conductively connected with the conductor 28. The switch 24 may be of numerous configurations, but is primary configured to interrupt current from flowing therethrough under certain circumstances, such as in the event of a reverse current condition, or on command.

Figure 1:
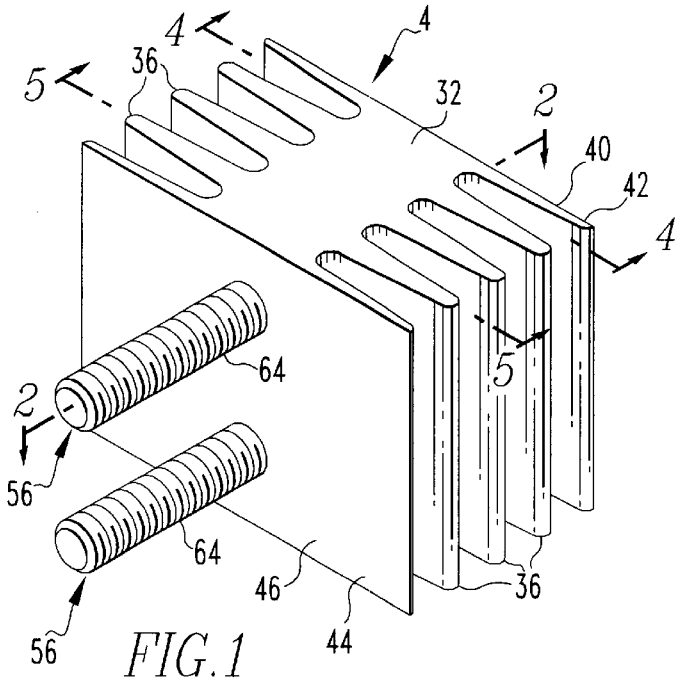
FIG. 1 is an isometric view of a conductive heat sink in accordance with the present invention.
Figure 2:
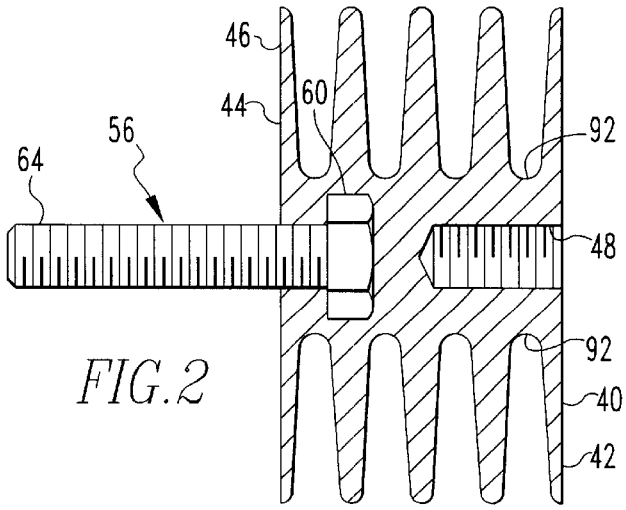
FIG. 2 is a sectional view as taken along line 2—2 of FIG. 1.

As can be seen in FIGS. 1 and 2, the heat sink 4 includes a substantially solid and rectangular core 32 from which depend a plurality of fins 36. The core 32 and the fins 36 are preferably integrally formed with one another as a monolithic member, meaning that the heat sink 4 is substantially free of joints between the core 32 and the fins 36. The core 32 and the fins 36 are thus electrically and thermally conductively connected with one another.

The heat sink 4 includes a initial end 40 and a terminal end 44 opposite one another. The initial end 40 includes a substantially planar first engagement surface 42, and the terminal end includes a substantially planar second engagement surface 46. As will be set forth more fully below, the first engagement surface 42 electrically and thermally conductively engages the switching apparatus 12, and the second engagement surface 46 electrically and thermally conductively engages the fuse 16.

The heat sink 4 is advantageously configured such that fins 36 are disposed at each of the initial and terminal ends 40 and 44 such that the respective fins 36 form a part of the generally planar initial and terminal ends 40 and 44 to increase the surface areas thereof. In this regard, the generally planar first and second engagement surfaces 42 and 46 can be said to extend across both the core 32 and a pair of fins 36.

While the first and second engagement surfaces 42 and 46 are as smooth and planar as can be economically justified, it is understood that a certain level of roughness will exist thereon. Such roughness will result in a certain amount of interface resistance at the area of contact with the fuse 16 or the conductor 28 as the case may be. By configuring the first and second engagement surfaces 42 and 46 to extend across a pair of opposite fins 36, the fins 36 advantageously increase the surface area of each of the first and second engagement surfaces 42 and 46 and increase the dissipation of heat generated by any such interface resistance. Nevertheless, in other embodiments of the heat sink 4 the first and second engagement surfaces 42 and 46 may not include fins 36.

The initial end 40 includes a pair of substantially cylindrical and threaded sockets 48 formed therein that extend through the first engagement surface 42. The sockets 48 are each configured to threadably receive therein a threaded first fastener 52 (FIG. 3) such as a bolt or a machine screw. It is understood, however, that in other embodiments, the sockets 48 and first fasteners 52 may cooperate in a non-threaded fashion, such as with the use of bayonet fittings, with interference fits between the sockets 48 and the first fasteners 52, and with other such attachment methodologies. If the sockets 48 and first fasteners 52 are removably connectable with one another, such removability will facilitate assembly and disassembly of the network protector 8 in the field, although such removability is not a requirement of the present invention.

A pair of second fasteners 56 protrude from the terminal end 44 of the heat sink 4 and extend through the second engagement surface 46. As is best shown in FIG. 2, each second fastener 56 includes a flared head 60 and an elongated threaded shank 64. Each shank 64 is threadably cooperable with a threaded nut 68 (FIG. 3). It is understood, however, that the second fasteners 56 may be of other configurations, threaded and non-threaded, as indicated above.

As can be understood from FIG. 2, the second fasteners 56 are substantially permanently mounted on the heat sink 4. More specifically, in the embodiment depicted in FIGS. 1–5, the heat sink 4 is formed by casting an electrically conductive material such as copper or aluminum around the second fasteners 56 such that the shanks 64 thereof protrude outwardly from the terminal end 44 and such that the heads 60 remain disposed internally within the heat sink 4. It is understood, however, that and that the heat sink 4 may be formed in other fashions and that the second fasteners 56 can be mounted on the heat sink 4 in still other fashions.

For instance, the second fasteners 56 may be in the form of machine screws around which the core 32 and fins 36 are cast. Alternatively, the second fasteners 56 may be in the form of cylindrical threaded members that are threaded into corresponding threaded sockets formed into the terminal end 44 or that are interference fit into non-threaded holes formed in the terminal end 44. The second fasteners may be made of the same electrically conductive material as the core 32 and fins 36, or may be made out of a different material. For instance, if the core 32 and fins 36 are cast out of copper or aluminum, the second fasteners may be made of the same material or may be made out of steel or still another material.

It is further understood that whatever the configuration of the second fasteners 56, the nuts 68 are cooperable therewith, whether the cooperation is threadable, is via bayonet fittings, or otherwise. It is preferred, however, that the nuts 68 be removable from the second fasteners 56 to permit removal and replacement of the fuse 16. The second fasteners 56 are preferably configured to securely electrically and thermally conductively engage the second engagement surface 46 with corresponding conductive surface of the fuse 16.

The heat sink 4 may be formed by stamping, forging, or other non-casting methodologies without departing from the concept of the present invention. The electrically conductive material out of which the heat sink 4 is made can include copper, aluminum, silver, and the like, as well as other materials and combinations of materials.

As is best shown in FIG. 3, the fuse 16 includes a fusible body 72 that is electrically interposed between a lower conductor 76 and an upper conductor 80. The fusible body 72 is any of a wide variety of electrically conductive members that can melt or fuse under certain specified conditions. The fusible body 72 may be of a copper/lead composition or may be of other compositions without departing from the concept of the present invention. The lower conductor 76 is formed with a pair of through bores (not shown) that receive the second fasteners 56 therethrough. The nuts 68 are then cooperated with the second fasteners 56, such as by threading the nuts 68 onto the shanks 64, to electrically and thermally conductivity engage the lower conductor 76 with the second engagement surface 46 of the heat sink 4.

The upper conductor 80 is seen as protruding through a wall 84 of the case 20. It is known that the region in the wall 84 through which the upper conductor 80 extends is sufficiently sealed to resist the entry of water and other foreign matter. It is further understood that the upper conductor 80 may remain entirely within the interior of the case 20 and be connected with an additional conductor that protrudes through the wall 84. The portion of the upper conductor 80 (or of the conductor connected therewith) that protrudes through the wall 84 is then connected with the network bus.

As can also be seen from FIG. 3, a line conductor 88 that is connected with the switch 24 similarly protrudes from the wall 84 of the case 20 for connection with the network transformer (not shown) that is, in turn, connected with a power source such as a substation. Again, it is known that the region of the wall 84 through which the line conductor 88 extends is sealed to resist the entry of water and other foreign matter.

As is understood from FIG. 3, the conductor 28 electrically and thermally conductively extends between the switch 24 and the heat sink 4. The first fasteners 52 securely engage the end of the conductor 28 with the first engagement surface 42 of the heat sink 4 to provide electrically and thermally conductive engagement between the conductor 28 and the heat sink 4. Such engagement further provides electrically and thermally conductive engagement between the heat sink 4 and the switch 24. In other embodiments (not shown) it may be desirable to interpose a conductive spacer between the conductor 28 and the heat sink 4 to achieve a desirable positioning of the heat sink 4 within the case 20.

In an AC application, with increased frequency the skin effect has a greater tendency to cause the current passing between the initial and terminal ends 40 and 44 to travel though the outer regions of the core 32. As can be seen in FIGS. 1 and 2, the core 32 includes a pair of sides 92 that are substantially parallel with one another. The fins 36 protrude substantially perpendicularly outwardly from the sides 92, whereby the fins 36 protrude outwardly in substantially opposite directions from the core 32. It is understood that in other embodiments the fins may additionally protrude outwardly from the upper and lower surfaces of the core 32 to provide an additional measure of heat dissipation.

With the skin effect, the current is caused to flow through the sides 92 and at least partially through the fins 36. Such conduction of current results in the generation of heat due to electrical resistance, which correspondingly results in an increase in the temperature of the heat sink 4 at the outer regions of the core 32 through which the current travels. The fins 36 thus advantageously conduct heat away from these regions of elevated temperature and convect the heat to the air within the case 20, which has the effect of reducing the temperature of such conductive regions. By reducing the temperature of such conductive regions, the conductive regions have an enhanced or increased ability to conduct current therethrough.

Figure 5:
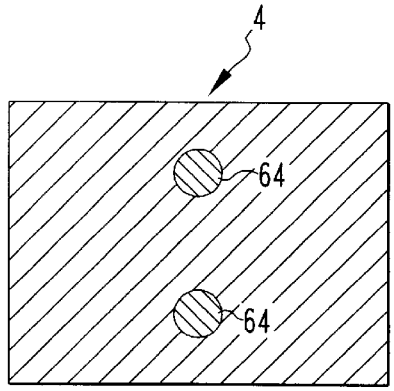
FIG. 5 is a sectional view as taken along line 5—5 of FIG. 1.
Figure 4:
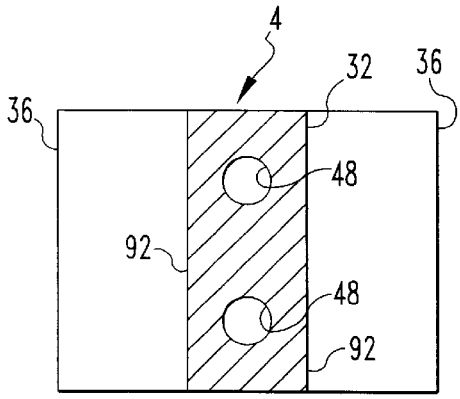
FIG. 4 is a sectional view as taken along line 4—4 of FIG. 1.

As can be seen in FIGS. 4 and 5, the cross section of the heat sink 4 as measured across the fins 36 (FIG. 5) is substantially greater than the cross section of the heat sink 4 as measured across only the core 32 (FIG. 4). By configuring the heat sink 4 with the conductive fins 36 that conduct heat away from current-carrying regions of the heat sink 4 and convect the heat to the surrounding air, the heat sink 4 can dissipate heat therefrom.

As can further be understood from the foregoing, the heat sink 4 will operate at a relatively lower steady state temperature than the fuse 16 and the switch 24 due to the ability of the heat sink 4 to function as an electrical conductor that can dissipate heat therefrom. As such, the fuse 16 and the switch 24 being at a relatively higher temperature will naturally conduct heat to the heat sink 4, and the heat sink 4 will thus dissipate the heat therefrom. As such, since the heat sink 4 is highly effective at convecting heat therefrom into the surrounding area, heat will be correspondingly conducted from the switch 24 and the fuse 16 to the heat sink 4 for dissipation therefrom until the network protector 8 reaches a steady state thermal operating condition. It thus can be understood that the steady state thermal condition of the network protector 8 that incorporates the heat sink 4 therein will be at a lower temperature than a similar network protector 8 that does not incorporate the heat sink 4. Accordingly, the heat sink 4 functions to reduce the operating temperature of the fuse 16 and the switch 24, and likewise reduces the operating temperature of the network protector 8 at steady state. Such a reduction in temperature of the network protector 8 has the corresponding effect of reducing the temperature of the network bus by conducting less heat thereto.

By configuring the heat sink 4 to be both thermally and electrically conductive, the current that is carried through the heat sink 4 has the advantageous effect of accelerating the cooling of the heat sink 4, which correspondingly reduces the temperature both of the network protector 8 and of the network bus. The ability of the heat sink 4 to operate at a relatively low temperature is enhanced by the core 32 and the fins 36 being integrally formed with one another as a monolithic member, which increases electrical and thermal conductivity therebetween. Such reduced temperatures enhance reliability and prolong the life of such components, which permits less frequent repair and replacement and corresponding cost savings.

Figure 6:
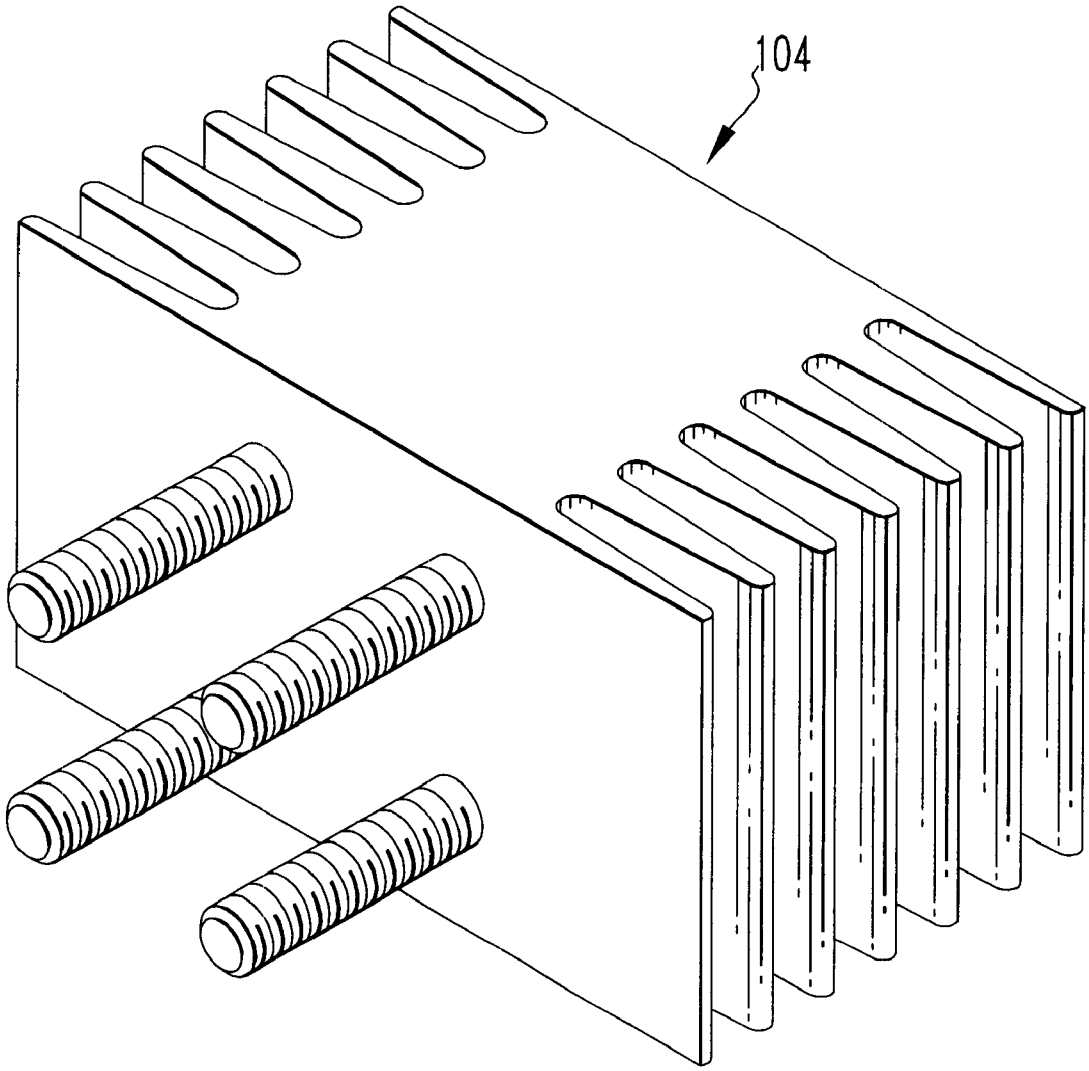
FIG. 6 is an isometric view of a second embodiment of a conductive heat sink in accordance with the present invention.

A conductive heat sink 104 in accordance with a second embodiment of the present invention is indicated generally in FIG. 6. The conductive heat sink 104 is larger than the heat sink 4 and includes an increased number of sockets and fasteners for connection with larger fuses and conductors. The conductor 104 thus has a higher current carrying capacity than the heat sink 4 and is thus suited to different applications.

While particular embodiments of the present invention have been described herein, it is understood that various changes, additions, modifications and adaptations may be made without departing from the scope of the present invention as set forth in the following claims.

What is claimed is:

1. An electrically conductive heat sink structured to be electrically interposed within an electrical circuit between a first conductor having a first electrical potential and a second conductor having a second electrical potential, the first electrical potential being different than the second electrical potential, the heat sink comprising:

a core;

a plurality of fins extending outwardly from the core;

the core and the fins being integrally formed with one another as a monolithic member;

the core having an initial end and a terminal end opposite one another, the initial end being structured to be electrically conductively engaged with the first conductor of the electrical circuit, the terminal end being structured to be electrically conductively engaged with the second conductor of the electrical circuit;

conductively engaged with the second conductor of the electrical circuit;

the heat sink being manufactured at least partially out of an electrically conductive material;

the heat sink being structured to conduct current between the first conductor and the second conductor;

the initial end and the terminal end each including one of a socket and a fastener; and in which the initial end includes a substantially planar first engagement surface disposed adjacent the one of a socket and a fastener, the first engagement surface being structured to electrically conductively engage the first conductor, and in which the terminal end includes a substantially planar second engagement surface disposed adjacent the one of a socket and a fastener, the second engagement surface being structured to electrically conductively engage the second conductor.

2. The heat sink as set forth in claim 1, in which the initial end includes a socket that extends into the first engagement surface and that is threaded and is structured to received a first threaded fastener therein, and in which the terminal end includes a second threaded fastener that extends outwardly from the second engagement surface.

3. The heat sink as set forth in claim 2, in which the heat sink is formed by casting the electrically conductive material around the second threaded fastener.

4. The heat sink as set forth in claim 1, in which the first and second engagement surfaces each extend across at least one of the fins.

5. The heat sink as set forth in claim 4, in which the initial and terminal ends each extend across a pair of opposite fins.

6. The combination comprising:

a fuse; and an electrically conductive heat sink electrically and thermally conductively engaged with the fuse, the heat sink being structured to be electrically conductively connected with a conductor and being structured to conduct current between the conductor and the fuse and being further structured to conduct heat away from the fuse, the heat sink comprising:

a core;

a plurality of fins extending outwardly from the core;

the core and the fins being integrally formed with one another as a monolithic member;

the core having an initial end and a terminal end opposite one another, the initial end being structured to be electrically conductively engaged with the conductor, the terminal end being structured to be electrically and thermally conductively engaged with the fuse;

the heat sink being manufactured at least partially out of an electrically conductive material;

the initial end including one of a socket and a fastener, and the terminal end including one of a fastener protruding outwardly therefrom and a socket having a fastener therein; and in which the initial end includes a socket that is threaded and is structured to received a first threaded fastener therein, and in which the initial end includes a substantially planar first engagement surface disposed adjacent the socket and being structured to electrically conductively engage the conductor.

7. The combination as set forth in claim 6, in which the terminal end includes a second threaded fastener, and further includes a substantially planar second engagement surface disposed adjacent the second fastener, in which the second threaded fastener electrically and thermally conductively engages the second engagement surface with the fuse.

8. The combination as set forth in claim 7, in which the first and second engagement surfaces each extend across at least one of the fins.

9. A network protector comprising:

a switching apparatus;

a fuse;

an electrically conductive heat sink electrically interposed between the switching apparatus and the fuse, the heat sink being structured to conduct current between the switching apparatus and the fuse and being further structured to conduct heat away from the fuse;

the heat sink including a core and a plurality of fins extending outwardly from the core, the core and the fins being integrally formed with one another as a monolithic member;

the core having an initial end and a terminal end, the initial end being electrically conductively engaged with the switching apparatus, the terminal end being electrically and thermally conductively engaged with the fuse;

the heat sink being manufactured at least partially out of an electrically conductive material;

said initial end includes one of a socket and a fastener, and in which the terminal end includes one of a socket and a fastener; and in which switching apparatus includes a switch and a conductor, the conductor extending between the switch and the heat sink, in which the initial end includes a substantially planar first engagement surface electrically conductively engaged with the conductor, and in which the terminal end includes a substantially planar second engagement surface electrically and thermally conductively engaged with the fuse.

10. The network protector as set forth in claim 9, in which the initial end includes a socket that extends into the first engagement surface and that threadably receives a first threaded fastener therein, the first threaded fastener electrically conductively engaging the first engagement surface with the conductor, and in which the terminal end includes a second threaded fastener that extends outwardly from the second engagement surface, the second threaded fastener electrically and thermally conductively engaging the second engagement surface with the fuse.

11. A network protector comprising:

a switching apparatus;

a fuse;

an electrically conductive heat sink electrically interposed between the switching apparatus and the fuse, the heat sink being structured to conduct current between the switching apparatus and the fuse and being further structured to conduct heat away from the fuse;

the heat sink including a core and a plurality of fins extending outwardly from the core, the core and the fins being integrally formed with one another as a monolithic member;

the core having an initial end and a terminal end, the initial end being electrically conductively engaged with the switching apparatus, the terminal end being electrically and thermally conductively engaged with the fuse;

the heat sink being manufactured at least partially out of an electrically conductive material; and in which the network protector further comprises a substantially watertight case, the switching apparatus, the fuse, and the heat sink being disposed with the case.

* * * * *